US007203432B2

(12) United States Patent
Morioka et al.

(10) Patent No.: US 7,203,432 B2
(45) Date of Patent: Apr. 10, 2007

(54) JOB PROCESSING APPARATUS

(75) Inventors: Hirohito Morioka, Kitakatsuragi-gun (JP); Mikiya Okada, Nara (JP); Tsutomu Itai, Yamatokoriyama (JP); Hirotaka Kodama, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 258 days.

(21) Appl. No.: 11/057,555

(22) Filed: Feb. 14, 2005

(65) Prior Publication Data

US 2005/0180769 A1 Aug. 18, 2005

(30) Foreign Application Priority Data

Feb. 18, 2004 (JP) ..... 2004-041570

(51) Int. Cl.
*G03G 15/00* (2006.01)

(52) U.S. Cl. ..... 399/37; 399/88

(58) Field of Classification Search ..... 399/8, 399/37, 81, 85, 88; 713/320; 358/1.14
See application file for complete search history.

(56) References Cited

U.S. PATENT DOCUMENTS 5,321,478 A * 6/1994 Nakamura et al. ..... 399/70
5,589,923 A * 12/1996 Lee et al. ..... 399/78
5,884,122 A * 3/1999 Kawabuchi et al. ..... 399/88
5,923,889 A * 7/1999 Kim et al. ..... 713/323
5,923,919 A * 7/1999 Nimura et al. ..... 399/37
6,134,401 A * 10/2000 Yun et al. ..... 399/70
7,099,604 B2 * 8/2006 Nishimoto et al. ..... 399/88
7,106,468 B2 * 9/2006 Jinbo et al. ..... 358/1.15
7,120,372 B2 * 10/2006 Kim et al. ..... 399/70

FOREIGN PATENT DOCUMENTS

JP 08241023 A * 9/1996
JP 10105291 A * 4/1998
JP 2000-313997 5/2000
JP 2000-184106 6/2000
JP 2003215987 A * 7/2003
JP 2004-284280 10/2004

* cited by examiner

*Primary Examiner*—Robert Beatty
(74) *Attorney, Agent, or Firm*—Renner, Otto, Boisselle & Sklar, LLP

(57) ABSTRACT

A job processing apparatus includes a job executing section, an operating section, an interface section, and a control section. The control section shifts the job processing apparatus from a normal operation mode to a power-saving operation mode after a lapse of standby time T during which no command input to the job executing section is detected. The control section returns the job processing apparatus from the power-saving operation mode to the normal operation mode when a command input to the job executing section is detected in the power-saving operation mode. The control section utilizes standby time T1, instead of the standby time T, if a last job executed by the job executing section is according to job data input through the interface section. The standby time T1 is shorter than the standby time T.

5 Claims, 8 Drawing Sheets

JOB PROCESSING APPARATUS

CROSS REFERENCE

This Nonprovisional application claims priority under 35 U.S.C. § 119(a) on Patent Application No. 2004-041570 filed in Japan on Feb. 18, 2004, the entire contents of which are hereby incorporated by reference.

BACKGROUND OF THE INVENTION

The present invention relates to a job processing apparatus for executing a job according to job data included in an input command.

Job processing apparatus having a power-saving feature automatically shift from a normal operation mode to a power-saving operation mode after a lapse of a specified time period during which no job data is input. A job processing apparatus herein is an apparatus for executing a job according to input job data, such as a personal computer, a printer, or a copying machine. In the job processing apparatus in the power-saving operation mode, power is supplied only to circuits having functions required for return to the normal operation mode. The shift to the power-saving operation mode allows the job processing apparatus to be ready for an incoming command with reduced power consumption.

When a command including job data is input in the power-saving operation mode, however, the job processing apparatus needs to be returned to the normal operation mode before execution of a job according to the input command is initiated. The job processing apparatus in the power-saving operation mode thus takes a longer time to complete a job than in the normal operation mode. Accordingly, the more often the job processing apparatus shifts to the power-saving operation mode, the more possible it is that an operator waits long for a job to be completed.

In view of the foregoing, Japanese Patent Application Laid-open No. 2000-184106 discloses a job processing apparatus as a facsimile machine that shifts to the power-saving operation mode after a time period longer in proportion to frequency of access to the job processing apparatus.

However, it is preferable to take operators' psychology into consideration in determining length of the time period after which the job processing apparatus shifts to the power-saving operation mode. For example, waiting for a job to be completed by the job processing apparatus is more frustrating for an operator who operates the apparatus directly than for an operator who operates the apparatus remotely. The invention disclosed in Japanese Patent Application Laid-open No. 2000-184106 does not take into consideration such frustration of operators.

A feature of the present invention is to offer a job processing apparatus capable of shifting the apparatus from the normal operation mode to the power-saving operation mode at an optimum time for operators.

SUMMARY OF THE INVENTION

The job processing apparatus of the present invention includes a job executing section, an operating section, an interface section, and a control section. The job executing section executes a job according to a command including job data. The operating section outputs a command to the job executing section based on an input operation of an operator. The interface section is connected to external devices for outputting a command to the job executing section. The control section shifts the job processing apparatus to either the normal operation mode or the power-saving operation mode.

The control section normally shifts the job processing apparatus from the normal operation mode to the power-saving operation mode after a lapse of standby time T during which no command is input. The control section shifts the job processing apparatus to the power-saving operation mode after a lapse of standby time T1 ($0 \leqq T1 < T$), instead of the standby time T, under specific conditions such as that a last job executed by the job executing section is according to job data input through the interface section.

If the last job is according to job data input through the operating section, the standby time T is used because an operator requesting the last job is present near the job processing apparatus and is thus more likely to input a subsequent command. If the last job is according to job data input through the interface section, the standby time T1, which is shorter than the standby time T, is used because the operator requesting the last job is away from the job processing apparatus and is thus less likely to input a subsequent command.

Thus, on inference that a subsequent job is less likely to be executed, the control section shifts the job processing apparatus to the power-saving operation mode immediately, thereby allowing power consumption to be reduced. This is based on consideration that the immediate shifting to the power-saving operation mode is less inconvenient to an operator if a subsequent job is less likely to be executed.

DETAILED DESCRIPTION OF THE INVENTION

Figure 1:
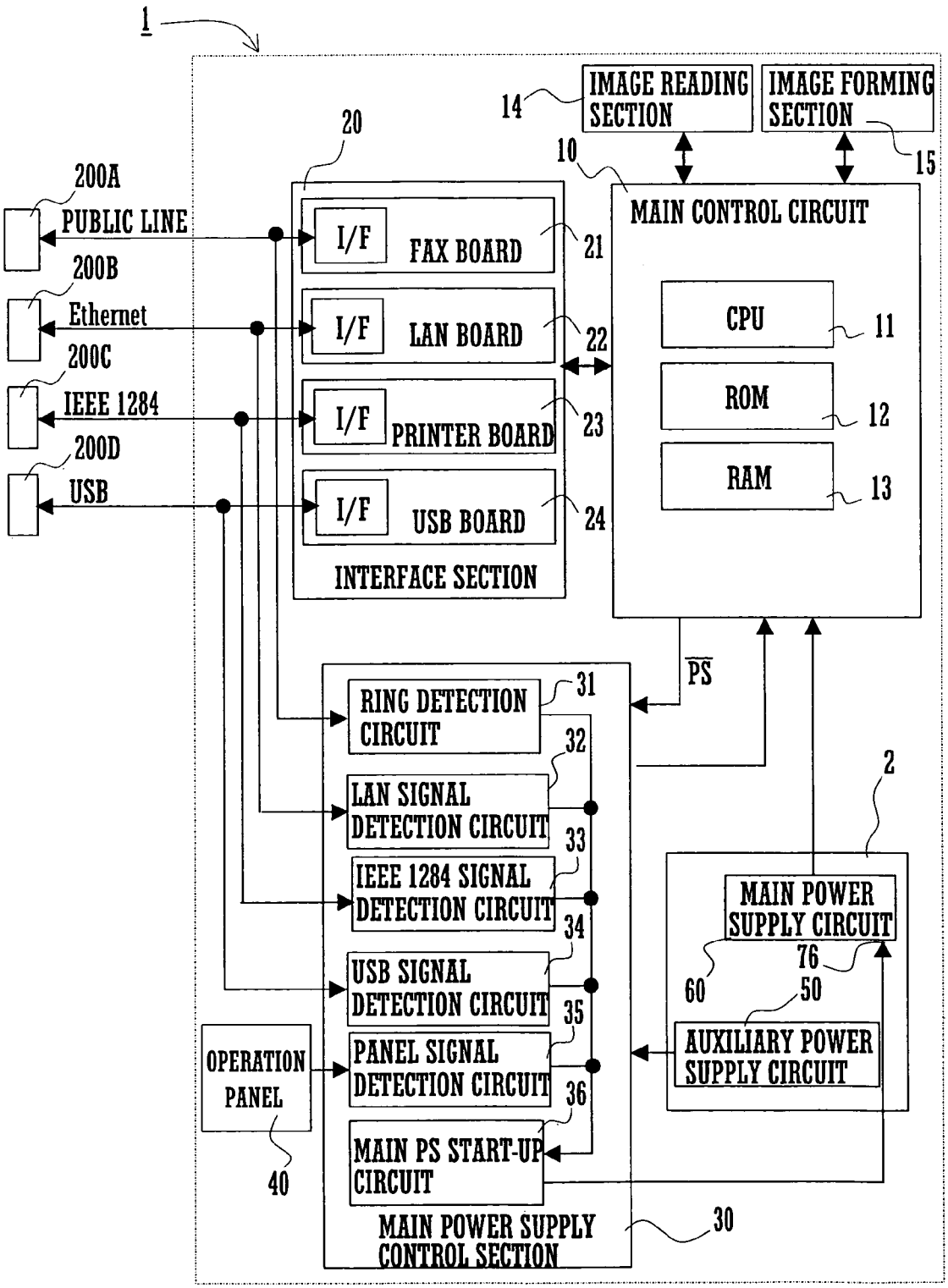
FIG. 1 is a schematic block diagram illustrating a configuration of a multi-function printer.

Referring to FIG. 1, a multi-function printer (hereinafter merely as MFP) 1 has a power supply section 2, a main power supply control section 30, a main control circuit 10, an interface section 20, an image reading section 14, an image forming section 15, and an operation panel 40.

The image reading section 14 utilizes an optical unit to scan an image of an original placed on a not-shown original platen. The image forming section 15 performs an image forming operation according to image data input through the main control circuit 10.

The interface section 20 is utilized for communication between the MFP 1 and external devices 200A to 200D. In the present embodiment, commands from the external devices 200A to 200D are input to the image forming section 15 through the interface section 20.

The interface section 20 has a FAX board 21, a LAN board 22, a printer board 23, and a USB board 24.

The FAX board 21 is used for communication of FAX data input and output through a public line. The LAN board 22 is used for data communication over Ethernet within a local area network ("Ethernet" is a trademark). The printer board 23 is used for communication with an external personal computer through an IEEE 1284 interface. The USB board 24 is used for communication with a USB device, such as a digital camera or an image storage device, through a USB interface.

The main power supply control section 30 has a ring detection circuit 31, a LAN signal detection circuit 32, an IEEE 1284 signal detection circuit 33, a USB signal detection circuit 34, a panel signal detection circuit 35, and a main power supply start-up circuit 36. The ring detection circuit 31 detects FAX data received through the public line. The LAN signal detection circuit 32 detects input of communication data over Ethernet within the local area network. The IEEE 1284 signal detection circuit 33 detects a signal input from the external device 200C through the IEEE 1284 interface. The USB signal detection circuit 34 detects a signal input from the external device 200D through the USB interface. The panel signal detection circuit 35 detects whether a button on the operation panel 40 is pressed by an operator. The main power supply start-up circuit 36 controls on/off of a main power supply circuit 60 in accordance with the signals input from the circuits 31 to 35 and from the main control circuit 10.

The operation panel 40 is used for an operator to input commands to the image forming section 15. The commands include: a command for returning the MFP 1 in the power-saving mode to the normal operation mode; a command for copying an original with the image reading section 14; a command for setting print magnification and the number of print copies for the image forming section 15; a command for confirming a job status or a FAX destination number; and a command for checking how much toner is remaining.

The power supply section 2 includes an auxiliary power supply circuit 50 and the main power supply circuit 60. In the power-saving operation mode, the auxiliary power supply circuit 50 supplies power to the main power supply control section 30. In the normal operation mode, the main power supply circuit 60 supplies a predetermined amount of power to components of the MFP 1 including the main control circuit 10.

The main control circuit 10 having a CPU 11, a ROM 12, and a RAM 13 has overall control of operation of each of the components of the MFP 1. The main control circuit 10 is connected to each of the power supply section 2, the main power supply control section 30, the interface section 20, the image reading section 14, the image forming section 15, and the operation panel 40. When stopping the main power supply circuit 60, the main control circuit 10 outputs a $\overline{PS}$ signal (to be described later) to the main power supply control section 30. In the present embodiment, the main control circuit 10 corresponds to the control section of the present invention.

With no command received for more than a predetermined period of time, the main control circuit 10 switches to the power-saving operation mode to reduce standby power consumption. In the power-saving operation mode, the main power supply circuit 60 supplies no power to each component of the MFP 1 until the next command is input. Detecting an input start-up signal, the main control circuit 10 returns the MFP 1 to the normal operation mode. Then, the main power supply circuit 60 restarts supplying power to each component of the MFP 1 including the main control circuit 10.

Figure 2:
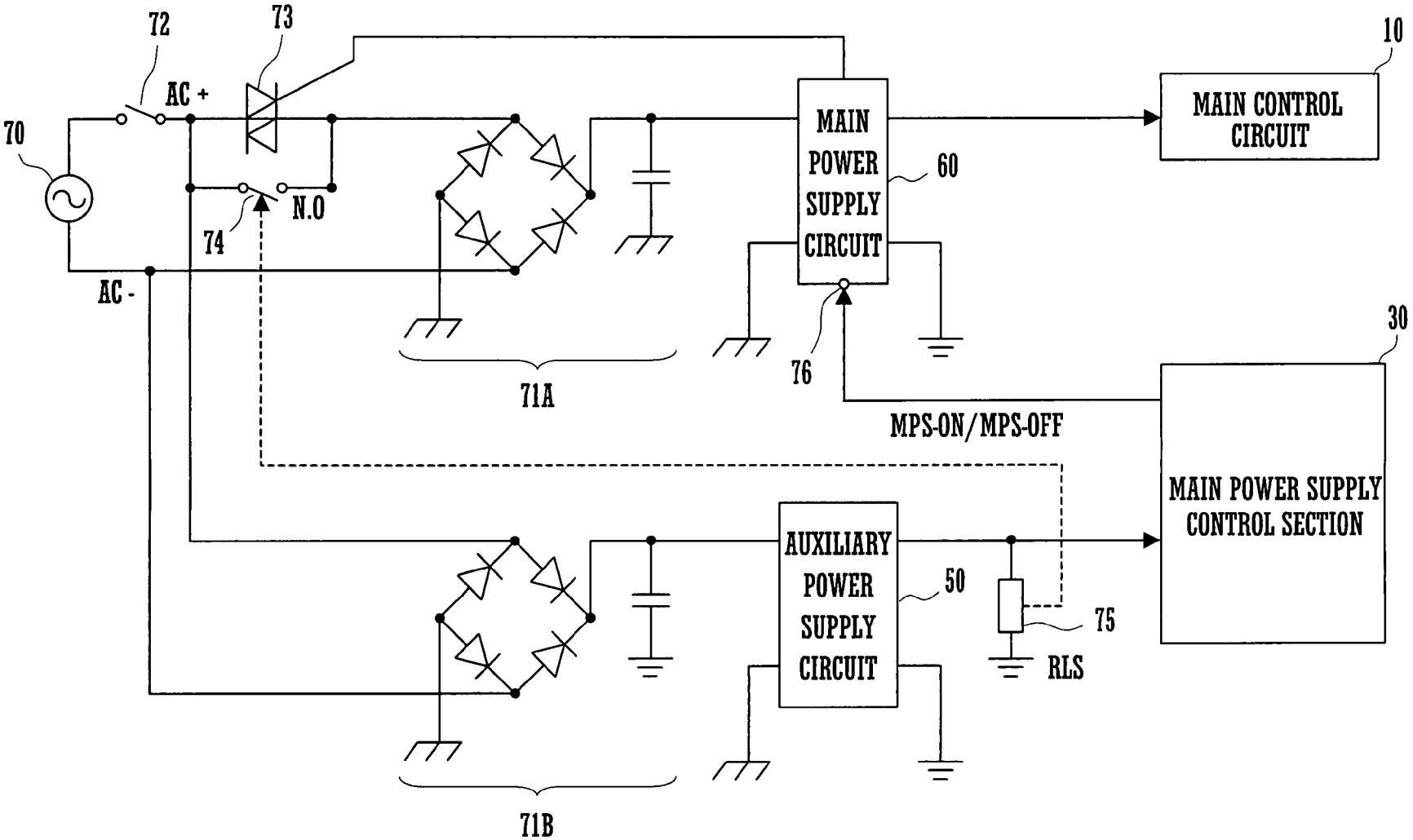
FIG. 2 is a diagram illustrating a configuration of a power supply circuit of the MFP.

Referring to FIG. 2, a commercial power supply 70 is connected to the auxiliary power supply circuit 50 through a main switch 72 and a smoothing circuit 71B. The main switch 72 is a switch for switching on/off a main power supply of the MFP 1. The smoothing circuit 71B provided for rectification and smoothing has a diode bridge and a capacitor. The auxiliary power supply circuit 50 is connected to a grounded relay coil 75 and the main power supply control section 30, respectively. The commercial power supply 70 is also connected to the main power supply circuit 60 through the main switch 72, a triac 73, a relay contact 74, and a smoothing circuit 71A. The triac 73 has a gate connected to the main power supply circuit 60. The relay contact 74 is a normally open relay contact that is switched open/closed by the relay coil 75. The triac 73 and the relay contact 74, connected in parallel, are both connected to the main switch 72 and to the smoothing circuit 71A. The smoothing circuit 71A is identical in design to the smoothing circuit 71B.

The main power supply circuit 60 is provided with an MPS signal input terminal 76. To the MPS signal input terminal 76, a low-level signal to switch on the main power supply circuit 60, or an MPS-ON signal, and a signal to switch off the main power supply circuit 60, or an MPS-OFF signal, are input selectively. The main power supply circuit 60 is connected to the gate of the triac 73 and to the main control circuit 10.

Described below is how the MFP 1 operates. The MFP 1 is activated by turning on the main switch 72. In the activation process, current flows from the commercial power supply 70 to the auxiliary power supply circuit 50 through the smoothing circuit 71B. Then, the auxiliary power supply circuit 50 supplies power to the relay coil 75. Current flowing through the relay coil 75 causes the relay contact 74 to be closed, thereby allowing current flow from the commercial power supply 70 to the main power supply circuit 60 through the relay contact 74 and the smoothing circuit 71A.

Subsequently, the main power supply circuit 60 starts to supply power to the gate of the triac 73, thereby allowing the triac 73 to become conductive. The main power supply circuit 60 also starts to supply power to the main control circuit 10, thereby allowing the MFP 1 to initiate operations.

Figure 3:
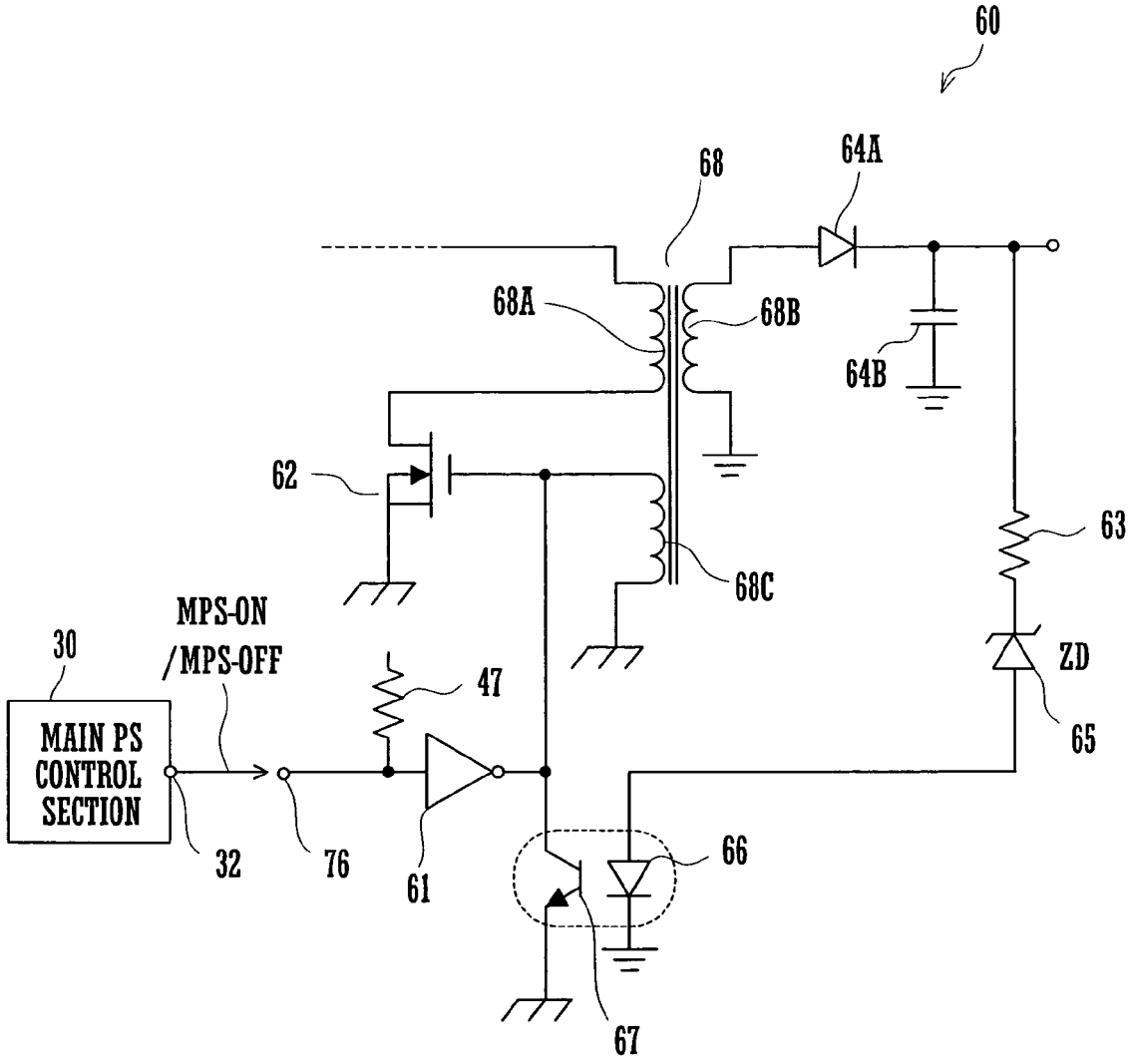
FIG. 3 is a diagram illustrating a configuration of principal parts of a main power supply circuit of the MFP.

Referring to FIG. 3, the main power supply circuit 60 is provided with a switching transformer 68 having a first primary winding 68A, a second primary winding 68C, and a secondary winding 68B. The first primary winding 68A is connected to the smoothing circuit 71A and a switching transistor 62. The secondary winding 68B is connected to an anode of a diode 64A, and a cathode of the diode 64A is connected to a grounded capacitor 64B and a power supply terminal.

A connection midway between the capacitor 64B and the power supply terminal is grounded through a resistor 63, a zener diode 65, and a light-emitting diode 66.

The switching transistor 62 has a gate connected to the second primary winding 68C and a phototransistor 67 with a grounded emitter. The phototransistor 67 has a collector connected to the MPS signal input terminal 76 through an inverter (open-collector) 61. A connection midway between the MPS signal input terminal 76 and the inverter 61 is connected to the auxiliary power supply circuit 50 through a pull-up resistor 47.

When an MPS-ON signal is input to the MPS signal input terminal 76, output of the inverter 61 is put in a high-impedance state, so that the gate of the switching transistor 62 becomes ungrounded. A valid feedback signal is thus input to the gate of the switching transistor 62 from the first primary winding 68A, thereby causing switching oscillation. The switching oscillation allows power supply from the secondary winding 68B to the main control circuit 10 through the power supply terminal.

When potential at the connection midway between the capacitor 64B and the power supply terminal reaches a predetermined value, current flows to the light-emitting diode 66 through the resistor 63 and the zener diode 65. Thus, the phototransistor 67 is turned on and the gate of the switching transistor 62 is forced to be grounded, so that the switching oscillation of the switching transformer 68 is stopped. The switching on/off of switching oscillation allows sufficient power to be supplied from the main power supply circuit 60 to the main control circuit 10.

When an MPS-OFF signal is input to the MPS signal input terminal 76, in contrast, the gate of the switching transistor 62 is forced to be grounded. Switching oscillation of the switching transformer is thus stopped.

For example, when an MPS-OFF signal is input from the main power supply control section 30 to the MPS signal input terminal 76 in the normal operation mode, switching oscillation of the switching transformer is stopped. When an MPS-ON signal is input from the main power supply control section 30 to the MPS signal input terminal 76 in the power-saving operation mode, switching oscillation of the switching transformer is initiated.

The main power supply control section 30 outputs either an MPS-ON signal or an MPS-OFF signal to the MPS signal input terminal 76, according to the operation mode of the MFP 1. With no command input to the MFP 1 for more than a predetermined time, the main control circuit 10 outputs a power-save request signal to the main power supply control section 30. Upon receipt of the valid power-save request signal, the main power supply control section 30 outputs an MPS-OFF signal to the MPS signal input terminal 76.

Figure 4A:
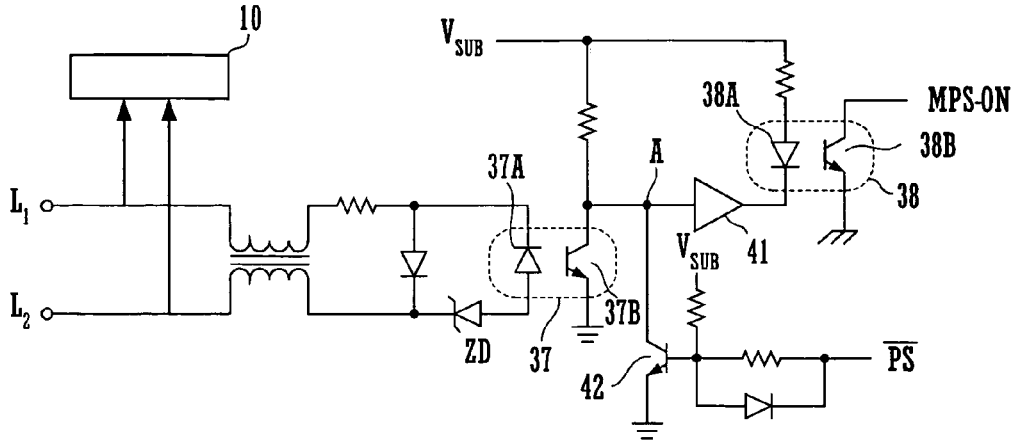
FIGS. 4A and 4B are diagrams each illustrating a configuration of principal parts of a main power supply control section.
Figure 4B:
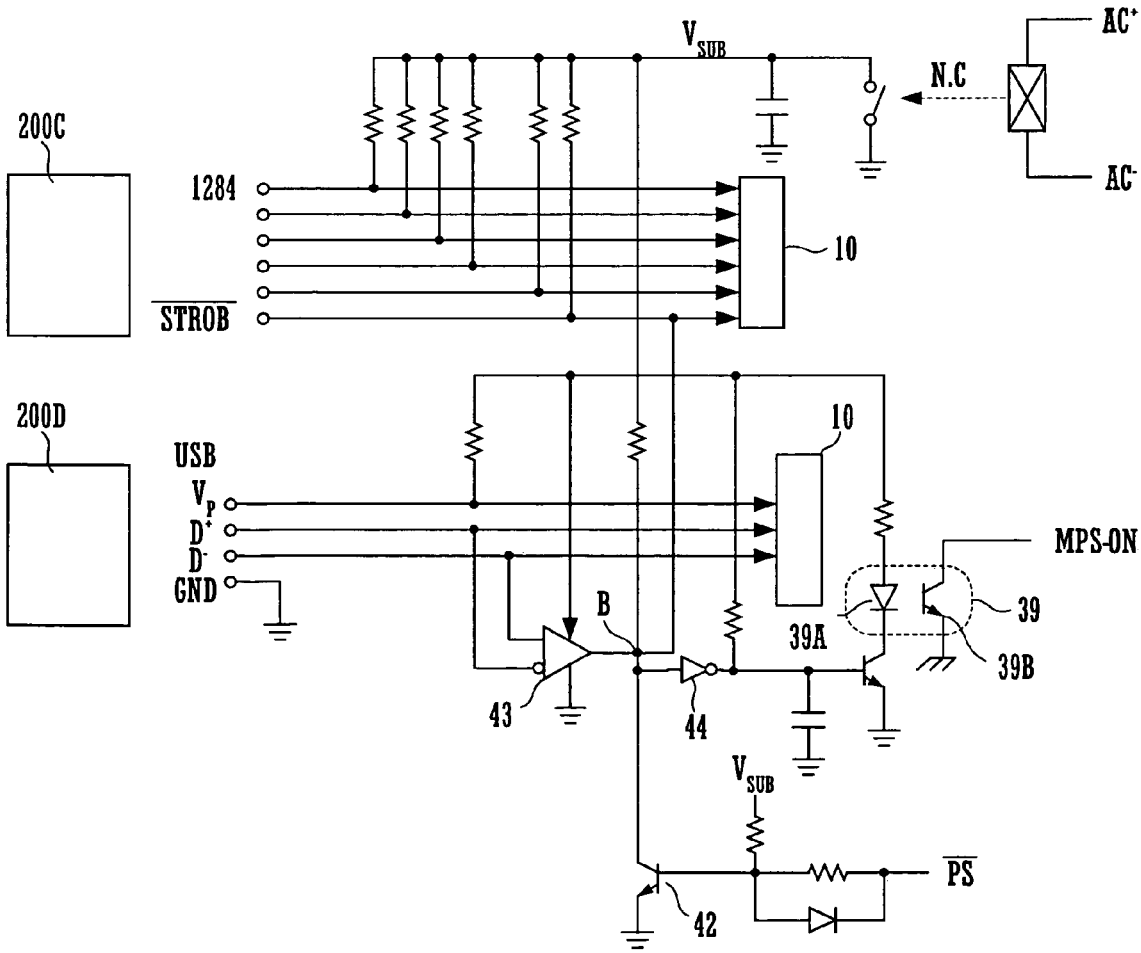

Illustrated in FIG. 4A is the ring detection circuit 31. The ring detection circuit 31 detects a FAX signal input through a public line as a start-up signal and turns the main power supply circuit 60 on. Illustrated in FIG. 4B are the IEEE 1284 signal detection circuit 33 and the USB signal detection circuit 34. The IEEE 1284 signal detection circuit 33 detects, as a start-up signal, a signal input from the external device 200C through the IEEE 1284 interface and turns the main power supply circuit 60 on. The USB signal detection circuit 34 detects, as a start-up signal, a signal input from the external device 200D through the USB interface and turns the main power supply circuit 60 on. In addition, FIG. 4B illustrates an example of configuration in which power supplied from a power supply line of the USB interface is utilized to switch the MFP 1 from the power-saving operation mode back to the normal operation mode.

As described above, input of an MPS-ON signal to the MPS signal input terminal 76 is required for turning the main power supply circuit 60 on. With a phototransistor 38B of a photocoupler 38 in nonconductive state, a high-level signal (MPS-OFF signal) is input to the inverter 61 through the pull-up resistor 47, as illustrated in FIG. 3, located on an input side of the inverter 61.

At this time, with the MFP 1 in the normal operation mode, potential VSUB of the auxiliary power supply circuit 50 is input to a base of a transistor 42, so that the transistor 42 becomes conductive. With the transistor 42 in conductive state, a connection point A in FIG. 4A has a low-level potential. Current is thus allowed to pass through a light-emitting diode 38A, so that the phototransistor 38B becomes conductive. Accordingly, an MPS-ON signal is input to the MPS signal input terminal 76, thereby turning the main power supply circuit 60 on.

With the MFP 1 in the power-saving operation mode, in contrast, a low-level $\overline{PS}$ signal is input to a base of the transistor 42, so that the transistor 42 becomes nonconductive. The connection point A thus has a high-level potential. Consequently, the photo-transistor 38B becomes nonconductive and an MPS-ON signal is prevented from being input to the MPS signal input terminal 76. The output of the inverter 61 becomes low-level and the gate of the switching transistor 62 is forced to be grounded, so that the main power supply circuit 60 is turned off.

When detecting a predetermined FAX signal input through a public line in the power-saving operation mode, as shown in FIG. 4A, a light-emitting diode 37A of a photocoupler 37 causes a phototransistor 37B to be conductive. The connection point A thus has a low-level potential and a buffer (open-collector) 41 is turned on, so that the phototransistor 38B of the photocoupler 38 becomes conductive. Since as a result an MPS-ON signal is input to the MPS signal input terminal 76, the main power supply circuit 60 is turned on again and the MFP 1 is returned from the power-saving operation mode to the normal operation mode.

FIG. 4B illustrates an example of configuration in which an IEEE 1284 signal or a USB signal is detected as a start-up signal, instead of the FAX signal in FIG. 4A. The MFP is switched from the power-saving operation mode back to the normal operation mode in a similar manner in the configuration as shown in FIG. 4A.

A feature of the configuration as shown in FIG. 4B is that power supplied from a power supply line VP of the USB interface is used to turn on the main power supply circuit 60 upon detection of the start-up signal.

As illustrated in FIG. 4B, a $\overline{STROB}$ signal and output of a line buffer (open-collector) 43 are in wired-OR connection at a connection point B, to be input to an inverter (open-collector) 44, so that a phototransistor 39B of a photocoupler 39 becomes conductive.

In FIGS. 4A and 4B, the phototransistor 39B and the phototransistor 38B are in wired-OR connection. Thus, when the photo-transistor 39B becomes conductive, an MPS-ON signal is input to the MPS signal input terminal 76 as in the above-described case where the transistor 38B becomes conductive. The main power supply circuit 60 is thus turned on again. Although not shown in the figure, there is an alternative configuration where power is supplied from a power supply line of an interface other than the USB interface.

Figure 5A:
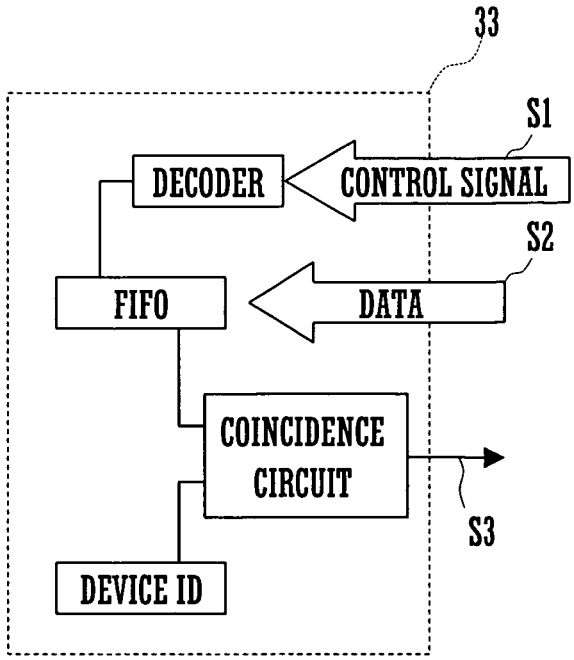
FIGS. 5A and 5B are block diagrams illustrating how a device ID and an ID of a input command are recognized, respectively.
Figure 5B:
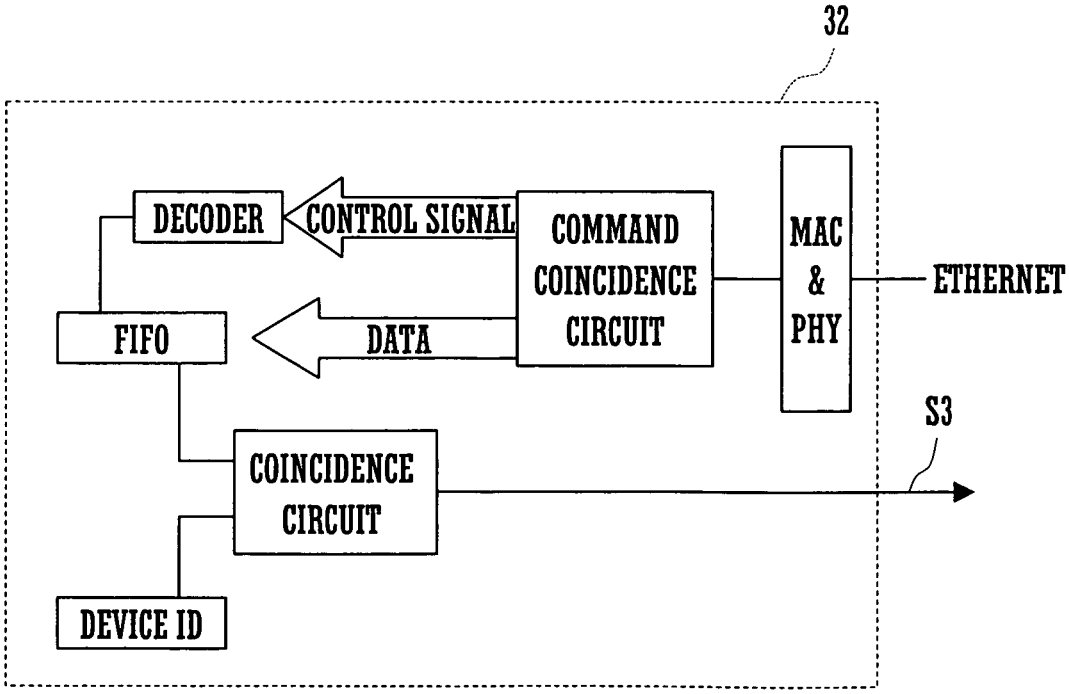

FIG. 5A shows how a device ID is recognized in the IEEE 1284 signal detection circuit 33 when a control signal S1 and data S2 are input through a IEEE 1284 interface. FIG. 5B shows how an ID of a command input through Ethernet is recognized in the LAN signal detection circuit 32.

As shown in FIGS. 5A and 5B, the IEEE 1284 signal detection circuit 33 and the LAN signal detection circuit 32 have limited functions of determining whether device ID data included in input data corresponds to pre-registered device ID data and of outputting, if the device ID data match, a start-up signal S3 to turn on the main power supply circuit 60. The limited functions allow the IEEE 1284 signal detection circuit 33 and the LAN signal detection circuit 32 to have a simplified configuration.

Figure 6:
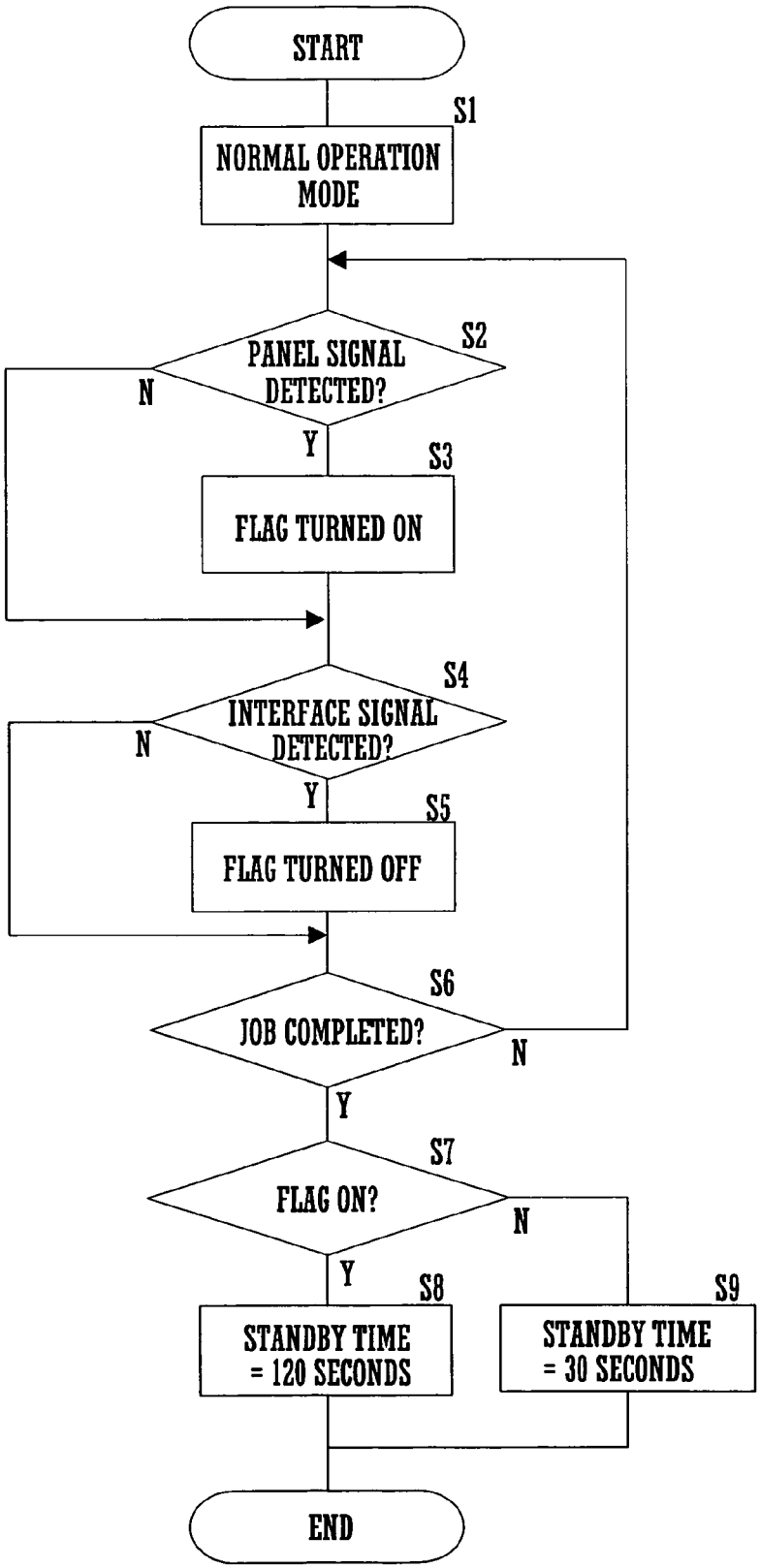
FIG. 6 is a flowchart of a process performed by the main power supply control section.

FIG. 6 is a flowchart of a process performed by the main control circuit 10. Described below is a process in which the main control circuit 10 sets standby time required for the MFP 1 to be shifted from the normal operation mode to the power-saving operation mode after completing a job in the normal operation mode (hereinafter referred to merely as power-saving standby time). In the following example, the main control circuit 10 modulates the power-saving standby time based on determination made as to whether a last job executed in the normal operation mode is according to a command input through the operation panel 40 or through the interface section 20.

When power is turned on, the main control circuit 10 sets the MFP 1 to the normal operation mode (step S1). In the normal operation mode, the main power supply control section 30 detects signals input through the operation panel 40 and through the interface section 20.

Upon detection of a signal input through the operation panel 40 by the panel signal detection circuit 35 (step S2), the main control circuit 10 turns on a flag (step S3). Upon detection of any of signals input from the external devices 200A to 200D by the ring detection circuit 31, the LAN signal detection circuit 32, the IEEE 1284 signal detection circuit 33, and the USB signal detection circuit 34, respectively (step S4), the main control circuit 10 turns off the flag (step S5).

The main control circuit 10 repeats the steps S2 to S5 as long as an unprocessed job remains. Accordingly, in the normal operation mode, the main control circuit 10 stands by until jobs according to input commands are all completed (step S6).

If the jobs are all completed at step S6, the main control circuit 10 determines whether or not the flag is on (step S7).

If the flag is on at step S7, the main control circuit 10 sets the power-saving standby time to default time T. In the present embodiment, the default time T is 120 seconds. It is to be noted that the default time T is not limited to 120 seconds and may be varied so as to be optimum depending on specific conditions.

If the flag is off at step S7, in contrast, the main control circuit 10 sets the power-saving standby time to time T1. In the present embodiment, the time T1 is 30 seconds. It is to be noted that the time T1 is not limited to 30 seconds and may be an arbitrary value within a range of $0 \leqq T1 < T$ depending on specific conditions.

Figure 7:
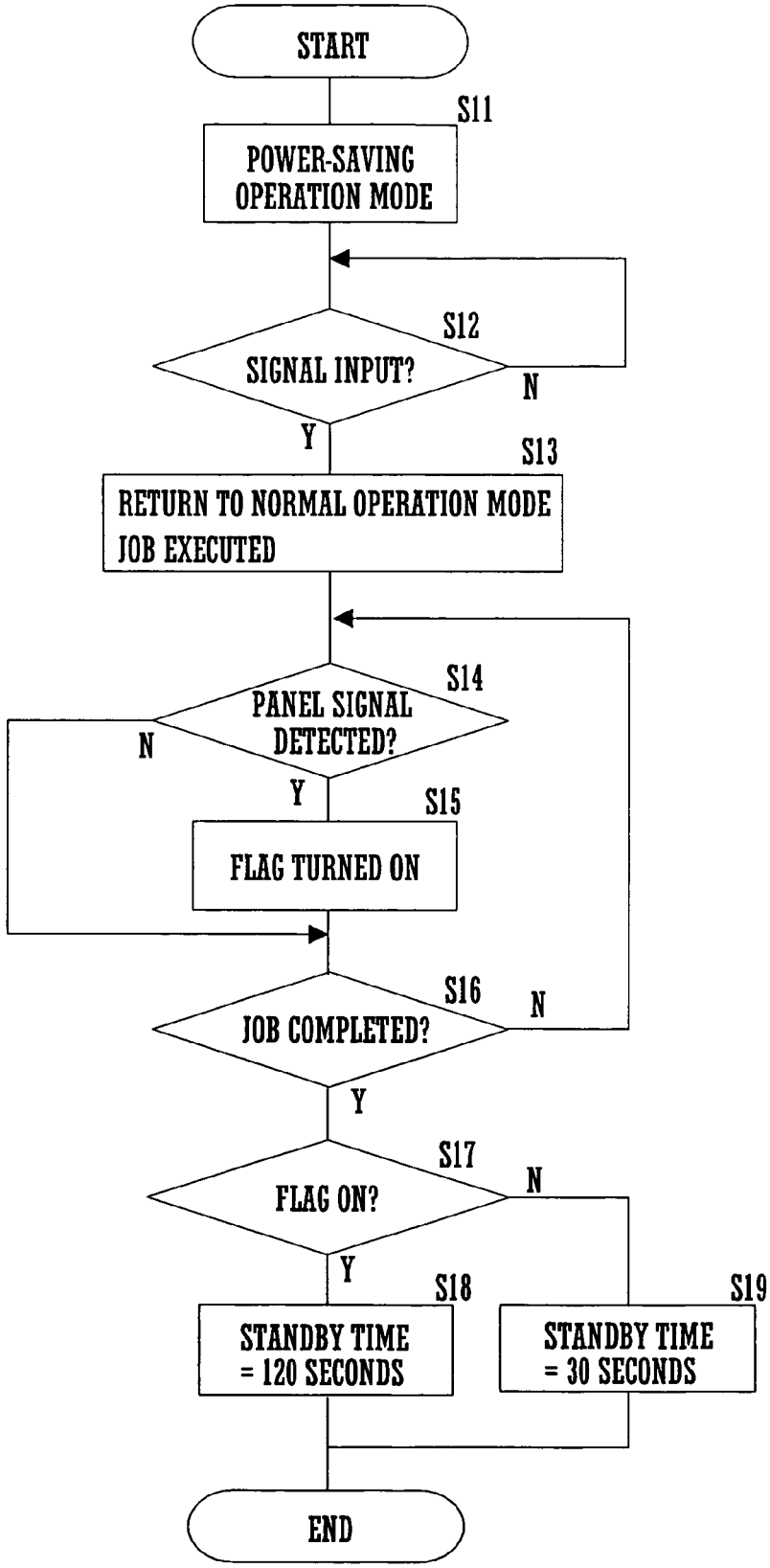
FIG. 7 is a flowchart of another process performed by the main power supply control section.

FIG. 7 is a flowchart of another process performed by the main control circuit 10. Described below is a process in which the main control circuit 10 sets the power-saving standby time after the MFP 1 is returned from the power-saving operation mode to the normal operation mode.

In the normal operation mode, the main control circuit 10 shifts the MFP 1 to the power-saving operation mode after a lapse of the time T (step S11). In the power-saving operation mode, the main control circuit 10 stands by until the main power supply control section 30 detects a signal input from the interface section 20 or from the operation panel 40 (step S12). During the standby period, the main control circuit 10 is deactivated with no power supplied thereto.

When the main power supply control section 30 detects an input signal at step S12, the main power supply circuit 60 is activated to initiate power supply to the main control circuit 10. With power supplied thereto, the main control circuit 10 makes the image forming section 15 execute a job according to an input command (step S13).

The main control circuit 10 determines whether or not the input command is a signal from the operation panel 40 (step S14). When the input command is a signal from the operation panel 40, the main control circuit 10 turns on the flag (step S15). While the job is being executed, the main control circuit 10 further determines whether or not the panel signal detection circuit 35 detects a signal (step S14). When the panel signal detection circuit 35 detects a signal, the main control circuit 10 turns on the flag (step S15). The main control circuit 10 repeats the steps S14 and S15 until unprocessed jobs are all completed.

In addition, the panel signal detection circuit 35 detects a signal generated by input of a command including job data, and a signal generated by an input operation for setting details of job processing. The details of job processing to be set include print magnification, number of copy to be printed, determination on necessity of post-processing, and the like. However, confirming job status or FAX destination number and checking on how much toner is remaining are not related to a job to be executed and may thus be excluded from the details of job processing.

The main control circuit 10 stands by until unprocessed jobs are all completed (step S16). When the unprocessed jobs are all completed at step S16, the main control circuit 10 determines whether or not the flag is on (step S17).

When the flag is on at step S17, the main control circuit 10 sets the power-saving standby time to the default time T that is 120 seconds as described above (step S18). When the flag is off at step S17, the main control circuit 10 sets the power-saving standby time to the time T1 that is 30 seconds as described above (step S19).

Then, if the main power supply control section 30 detects no subsequent signal within the power-saving standby time as set, the main control circuit 10 outputs a $\overline{PS}$ signal, thereby shifting the MFP 1 to the power-saving operation mode.

Figure 8:
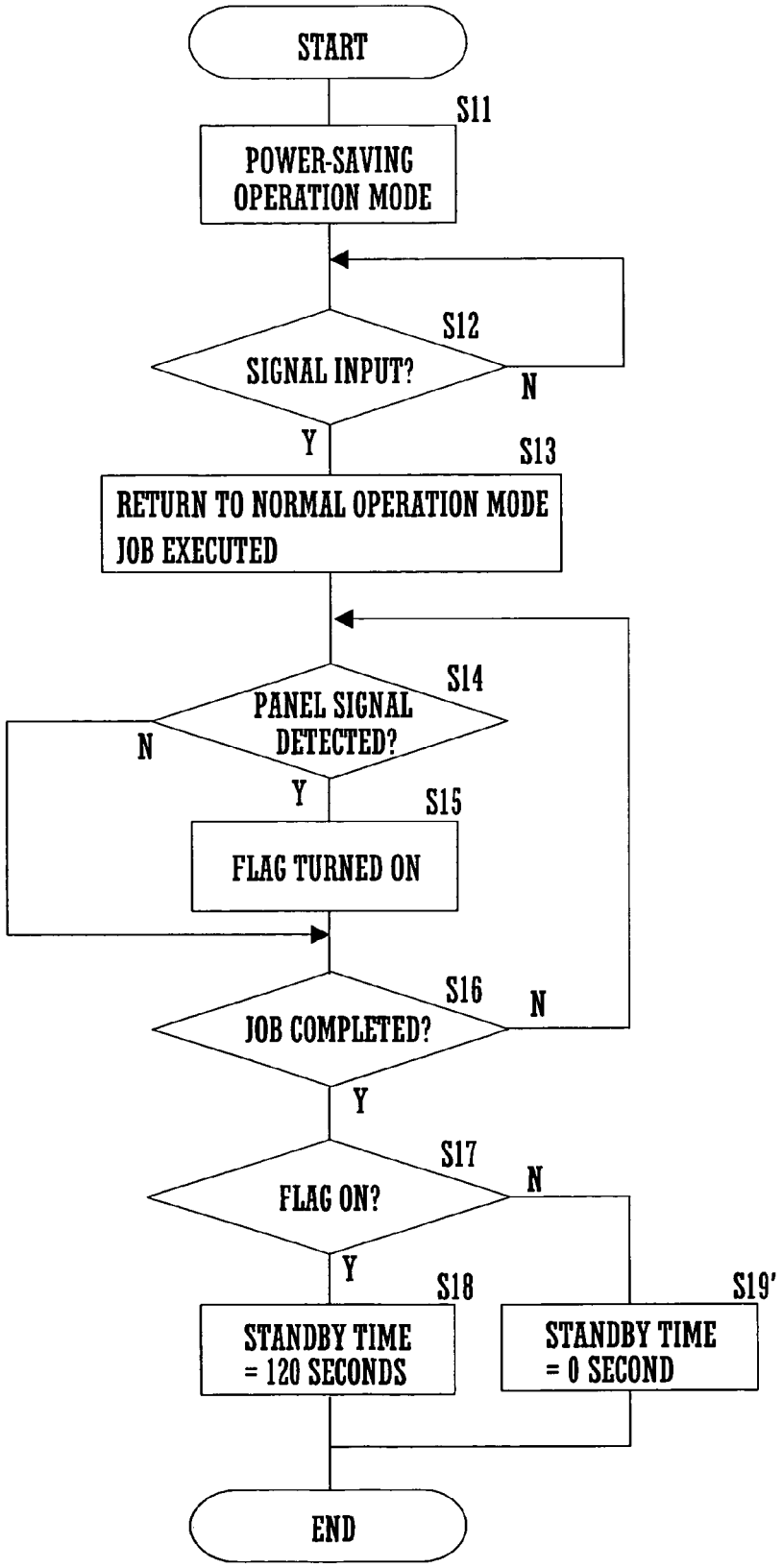
FIG. 8 is a flowchart of still another process performed by the main power supply control section.

FIG. 8 is a flowchart of still another process performed by the main control circuit 10. Described below with reference to FIG. 8 is a process in which the main control circuit 10 sets the power-saving standby time after the MFP 1 is returned from the power-saving operation mode to the normal operation mode.

The flowchart as in FIG. 8 is identical to the flowchart as in FIG. 7 except for step S19.

More specifically, when the flag is off at step S17, the main control circuit 10 shifts the MFP 1 to the power-saving operation mode immediately after the unprocessed jobs are all completed (step S19'). On inference that an operator is not present around where the MFP 1 is located, the main control circuit 10 immediately shifts the MFP 1 to the power-saving operation mode, thereby reducing power consumption of the MFP 1.

The embodiment as described above thus allows the MFP 1 to be shifted from the normal operation mode to the power-saving operation mode at an optimum time for an operator.

The present invention is applicable not only to the MFP 1 but also to a job processing apparatus, such as a personal computer, for executing a job according to an input command.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A job processing apparatus, comprising:

a job executing section for executing a job according to a command including job data;

an operating section for outputting a command to the job executing section based on an input operation of an operator;

an interface section connected to external devices for outputting a command to the job executing section; and a control section for shifting the job processing apparatus from a normal operation mode to a power-saving operation mode after a lapse of standby time T during which no command input to the job executing section is detected and for returning the job processing apparatus from the power-saving operation mode to the normal operation mode when a command input to the job executing section is detected in the power-saving operation mode, wherein the control section applies standby time T1 instead of the standby time T if a last job executed by the job executing section is according to job data input through the interface section, the standby time T1 being shorter than the standby time T.

2. A job processing apparatus according to claim 1, wherein the control section applies the standby time T1 instead of the standby time T, the standby time T1 being shorter than the standby time T, only if the control section returns the job processing apparatus from the power-saving operation mode to the normal operation mode according to job data input through the interface section and no command is input through the operating section while the job executing section is executing a job based on the job data.

3. A job processing apparatus according to claim 2, wherein the standby time T1 is set to zero.

4. A job processing apparatus according to claim 2, wherein the control section treats as a command input to the operating section an operation for setting details of job processing performed in the operation section prior to execution of a job.

5. A job processing apparatus according to claim 3, wherein the control section treats as a command input to the operating section an operation for setting details of job processing performed in the operation section prior to execution of a job.

* * * * *